US008410722B2

(12) United States Patent
Johler et al.

(10) Patent No.: US 8,410,722 B2
(45) Date of Patent: Apr. 2, 2013

(54) ILLUMINATION SYSTEM

(75) Inventors: Günter Johler, Dornbirn (AT); Manfred Petschulat, Wolfurt (AT); Thomas Roth, Taufkirchen (DE)

(73) Assignee: Zumtobel Lighting GmbH, Dornbirn (AT)

( * ) Notice: Subject to any disclaimer, the term of this patent is extended or adjusted under 35 U.S.C. 154(b) by 494 days.

(21) Appl. No.: 10/599,624

(22) PCT Filed: Mar. 23, 2005

(86) PCT No.: PCT/EP2005/003119

§ 371 (c)(1),
(2), (4) Date: Jul. 18, 2007

(87) PCT Pub. No.: WO2005/101918

PCT Pub. Date: Oct. 27, 2005

(65) Prior Publication Data

US 2007/0285026 A1 Dec. 13, 2007

(30) Foreign Application Priority Data

Apr. 15, 2004 (DE) ..... 10 2004 018 343

(51) Int. Cl.
*H05B 37/00* (2006.01)

(52) U.S. Cl. ..... 315/312; 315/209 R; 315/291; 315/247; 315/185 S

(58) Field of Classification Search ..... 315/312–326, 315/185 S

See application file for complete search history.

(56) References Cited

U.S. PATENT DOCUMENTS

| | | | | |
|---|---|---|---|---|
| 5,677,603 | A * | 10/1997 | Speirs et al. | 315/324 |
| 6,175,201 | B1 * | 1/2001 | Sid | 315/312 |
| 6,400,103 | B1 * | 6/2002 | Adamson | 315/292 |
| 7,701,151 | B2 * | 4/2010 | Petrucci et al. | 315/309 |
| 2001/0012206 | A1 * | 8/2001 | Hayami et al. | 362/464 |
| 2003/0127998 | A1 | 7/2003 | Notarianni et al. | 315/312 |
| 2003/0214259 | A9 * | 11/2003 | Dowling et al. | 315/312 |
| 2004/0000881 | A1 * | 1/2004 | Flory, IV | 315/312 |
| 2005/0116667 | A1 * | 6/2005 | Mueller et al. | 315/312 |
| 2005/0231134 | A1 * | 10/2005 | Sid | 315/294 |
| 2006/0125426 | A1 * | 6/2006 | Veskovic et al. | 315/312 |
| 2006/0132065 | A1 * | 6/2006 | Sears et al. | 315/312 |

FOREIGN PATENT DOCUMENTS

| | | |
|---|---|---|
| WO | WO 00/54557 | 9/2000 |
| WO | WO 02/35894 A1 | 5/2002 |

* cited by examiner

*Primary Examiner* — Tuyet Thi Vo
(74) *Attorney, Agent, or Firm* — Fitzpatrick, Cella, Harper & Scinto

(57) ABSTRACT

In an illumination system (1) having a control unit (2) and at least one de-central lamp operating device (12, 22) for operating one or more associated lamps (LA), the lamp operating device (12, 22) can be operated in different operational modes. In accordance with the invention the central control unit (2) and the lamp operating device (12, 22) are so configured that the selection and setting of an operational mode for the lamp operating device (12, 22) can be carried out from or via the central control unit (2).

8 Claims, 2 Drawing Sheets

ILLUMINATION SYSTEM

Figure 1:
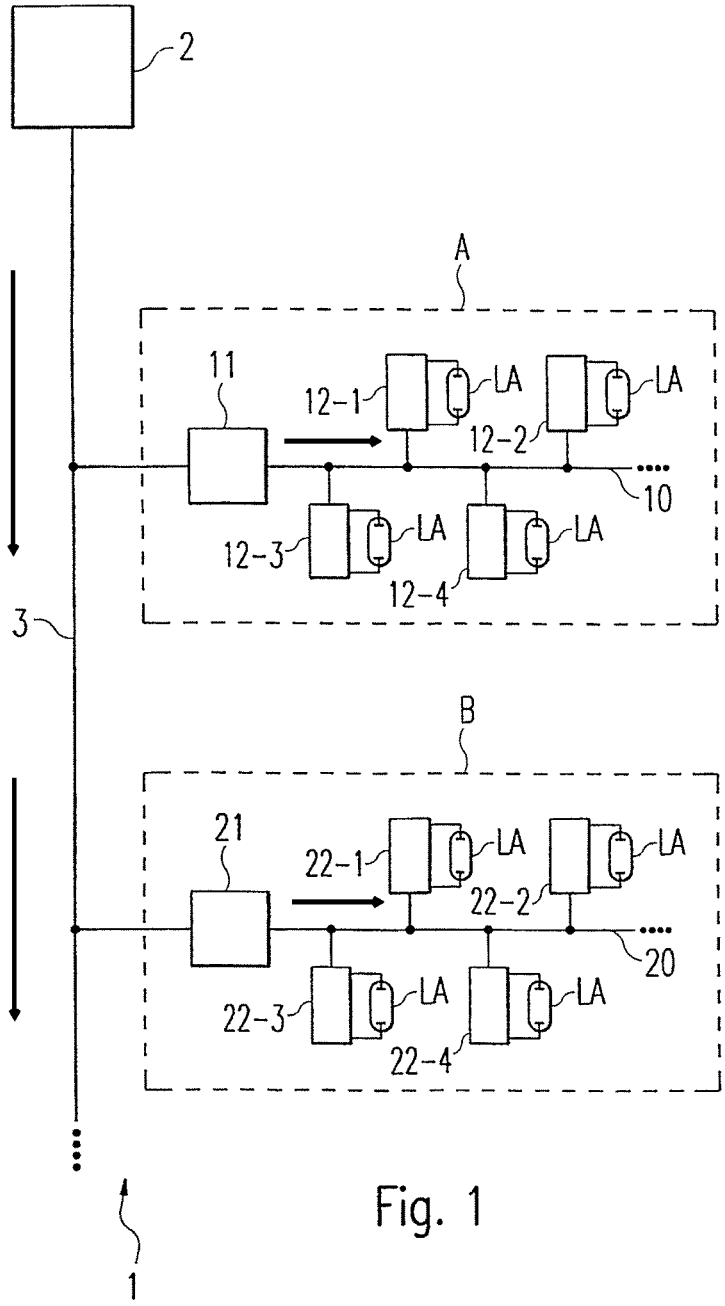

The present invention relates to an illumination system, which has a control unit and at least one de-central lamp operating device for operating a lamp, wherein the lamp operating device can be operated in different operational modes.

In larger buildings there are often put to use illumination systems which consist of a plurality of luminaires connected with one another via a bus line system. In each case a lamp operating device is associated with the luminaire, which device is responsible for the operation of the associated lamp. Thereby, more complex systems offer the possibility of controlling the individual lamp operating devices individually from a central station, in order for example to switch on and switch off the associated luminaires.

Alongside pure switch-on and switch-off functions, today modern lamp operating devices often offer also the possibility of setting the lamps in terms of their brightness; that is, to dim them. If such devices are to be incorporated into a large illumination system there are often put to use electronic ballasts which work in accordance with the so-called DALI (Digital Addressable Lighting Interface) standard. This standard was developed in order to be able to address individual luminaires in a comfortable manner by means of digital commands, in order to alter the luminaires in their brightness.

The above-described lamp operating devices corresponding to the DALI standard on the one hand work very satisfactorily and make possible great comfort in luminaire control, but on the other hand they require a relatively great investment outlay. In particular for the case that a user would be satisfied with purely switchable luminaires, i.e. luminaires which he can merely switch on and switch off, but not vary in their brightness, the costs for the provision of DALI lamp operating devices would be too high.

The present invention now proceeds from the consideration that the needs and requirements of an illumination system can also alter in the course of time. For example, different areas or rooms in larger buildings can often be used by different tenants, whose wishes of the corresponding illumination system change in the course of time, which may in particular be the case in the event of a change of tenant. Thus, the case can occur that a user is initially satisfied with merely switchable luminaires, for which no dimming function is present, whilst in contrast the new tenant would be prepared to accept also higher costs in order to be able to have the possibility of fine adjustment in brightness control. A change from one device type to another would, however, self-evidently be connected with an extremely high outlay in terms of costs and work.

The present invention now has the object of indicating a possibility of adapting the usable range of functions of a lamp operating device to the individual needs of a user in a manner which is as simple as possible.

This object is achieved by means of an illumination system which has the features of claim 1. Advantageous further developments of the invention are the subject of the dependent claims.

The solution in accordance with the invention is based on the idea of employing in principle dimmable lamp operating devices or in general devices having an extended range of functions, which however can be so set depending upon the needs of the user such that for the user they are either only switchable (on/off) or—so far as the need arises—have an extended scope of function. The required cost outlay with the employment of dimmable lamp operating devices is higher at the outset, but one assumes that at least a proportion of the users will wish to use also the extended possibilities of the lamp operating devices in the course of time, so that this cost outlay will be amortized, in particular taking into consideration that now large scale modification work with the use of new lamp operating devices can be avoided.

In accordance with a first aspect of the present invention there is thus proposed an illumination system which has a control unit and at least one lamp operating device for operating one or more lamps, wherein the lamp operating device is operable in different operational modes. In accordance with the invention, the control unit and the lamp operating device are so constituted that the selection and setting of an operational mode for the lamp operating device can be carried out from or through the central control unit. In particular it can be provided that the selection and setting of an operational mode is effected by means of the transmission of a corresponding control command—for example by a bus line system, which connects the control unit and the lamp operating device.

The alteration of the usable scope of function of the lamp operating device is thus effected in accordance with the present invention in that the corresponding function for the desired operational mode at the lamp operating device is released for use by means of the central control unit. As soon as this is the case, the user of the lamp operating device can use this fully within the released scope of function, so that there can be made available to the user—so far as desired—the full functional scope. If, on the other hand, a user wishes solely to switch the luminaires on and off, all further functions and operational modes of the lamp operating device can be blocked, so that the illumination system behaves in accordance with the wishes of the user. Through this there is thus created the possibility that for example the landlord of a larger building can determine individually in which way the various tenants can use their luminaires. Since in the case of use of an extended functional scope higher costs can be billed, the increased initial investment can be compensated in the course of time, since the releasing of the supplementary operational functions can be carried out very simply and in comparison with a reprogramming of the control devices or even an exchange with more sophisticated lamp operating devices, no costs are incurred.

It is to be noted that due to the fact that the settings effected in the lamp operating devices are noted, the solution in accordance with the invention offers the possibility of setting individual luminaires, in terms of their usable scope of function, individually, so that the possibility in fact is provided within the scope of the illumination system of making different luminaires usable in different ways.

The lamp operating devices, which in accordance with the invention are to be alterable in their usable functional scope, should preferably be capable of receiving control commands corresponding to the DALI standard. In order to make the present invention usable also for such devices, a software change in the lamp operating device is provided to the effect to that these are now able to receive an additional command in which the different modes of operation can be released or blocked by means of the control device. This software extension consists, however, also in that in dependence upon whether certain functions are released or not, the DALI commands are interpreted in a particular manner. For example, if the luminaire is to be merely switchable, a DALI dimming command would in principle be interpreted as switch-on, and solely the switch-off command in accordance with the DALI standard interpreted as a switch-off command.

Advantageously it is provided that the lamp operating device operates the associated lamp in principle within the scope of a base function, in which the lamp can be at least switched on and switched off. The possibility for alteration of the scope of function of the lamp operating device or for setting the operational mode can also be exploited for the purpose of ensuring a brightness of the luminaire which remains the same over a very long period of time.

In this context it is namely to be taken into account that luminaires in principle suffer a fall off in their light intensity in the course of time, which on the one hand is due to aging and wear of the lamp, in particular however also due to the various luminaire components, for example the reflectors or covers, becoming dirty.

Since through these wear and dirt phenomena the usability of the luminaires can be significantly affected, in the mean time there are Europe-wide standards which prescribe that the reduction of the lighting power must be corrected. The standard says that a lighting planer must fundamentally take into account that the luminaires suffer in their lighting power in the course of time and that correspondingly from time to time an adaptation or correction, or cleaning, must be effected. This is as a rule to be carried out by service personal.

The remotely controlled alteration of the functional scope of the lamp operating devices in accordance with the present invention now makes it possible to effect this subsequent correction or adaptation from a central station. It can for example be provided that, at the beginning of a period of use, the lamp operating device is so set that in switched-on condition the lamp operates only at a lighting power of about 80 to 90% of the available maximum value. Depending upon the kind of the luminaire type and taking into account values determined from experience, then for example periodically, in weekly or monthly intervals, the output power of the lamp operating device is raised to compensate for the light reduction, so that in the end, upon switching on of the luminaire, fundamentally the same lighting power is achieved also over a longer period of time.

The raising of the output power can now be effected through the central control unit, which through the transmission of appropriate commands so configures the base function that an appropriate output power is associated with the switch-on command. Beyond this, this solution brings also a further advantage in terms of energy, since in the end a saving of energy is attained.

Namely, to date, it was solely known to configure the luminaires with an increased initial value, for example a lighting value increased by the fact of 1.2, so that this in the course of time, with falling lighting power, would always still achieve at least the indicated desired lighting power. Through the present invention there arises the possibility fundamentally to emit light with the desired lighting power, but beyond this to use a higher factor as initial value, which is compensated through the lesser level of exercise of control. This brings with it the advantage that the period of time over which the luminaire has fallen to the desired value in terms of its lighting power, and therewith the time point at which at the latest a cleaning must be carried out and if applicable a lamp must be exchanged, can be extended. This means that the service cycles can be lengthened in accordance with the present invention, which brings with it a significant cost saving, since such servicing must always be carried out through the employment of a human work force, which is relatively expensive.

A second aspect of the present invention thus relates to a lamp operating device for the operation of an associated lamp, wherein the brightness level of the lamp in the switched-on condition or the maximum brightness level which can be set by means of the lamp operating device, can be changed through external control commands.

Figure 2A:
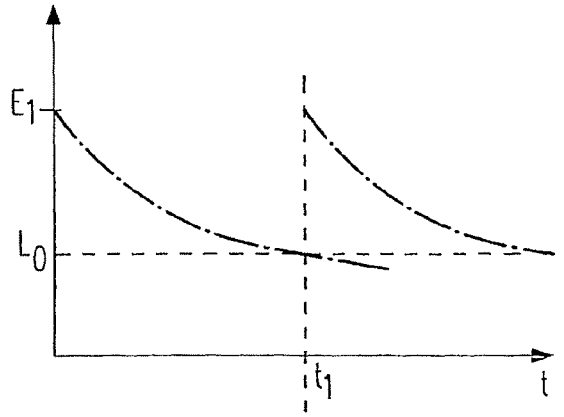
Figure 2B:
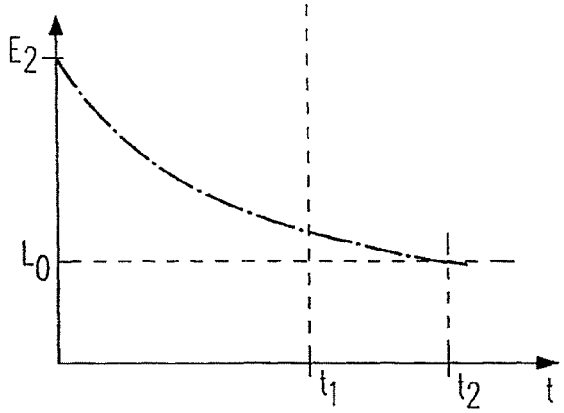
Figure 2C:
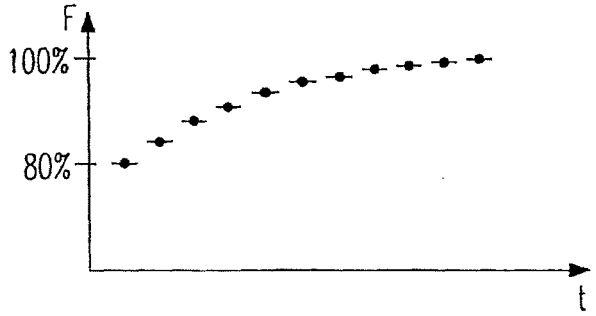

Below, the invention is to be described in more detail with reference to the accompanying drawings. There is shown:

FIG. 1 schematically an illumination system configured in accordance with the invention and FIGS. 2*a* to 2*c* curves for clarifying the improved maintenance possibilities with the illumination system in accordance with the invention.

FIG. 1 shows an illumination system, provided in general with the reference sign 1, which may be installed for example in a larger office building or the like. The illumination system 1 is divided into a plurality of subsystems A and B, which each represent an illumination system in accordance with the DALI standard. Each system A and B correspondingly has a local control unit 11 or 21, which are connected via corresponding lines 10 or 20 with luminaire control devices 12-1 to 12-4 or 22-1 to 22-4. Appropriate lamps LA are associated with the lamp operating devices, which lamps are operated by these devices.

The two subsystems A and B are further connected via additional bus lines 3 with a central control unit 2, which handles the central administration of the overall illumination system 1. The bus lines 3 for connecting the subsystems A and B with the central control unit 2 are not necessarily lines which are a component of a DALI system. As a rule, these will rather be other lines of a general building control system or the like.

The lamp operating devices 12 or 22 which are put to use are, in accordance with the invention, devices which have various functions for the control of the lamp LA associated therewith or can be operated in different operational modes. In the illustrated exemplary embodiment, which involves a device in accordance with the DALI standard, the associated lamps LA can be switched on and switched off and operated at various brightness values; that is, can be dimmed. The corresponding control signals are for this purpose transmitted via the associated bus lines 10 or 20 of the respective subsystem, which can be entered by the user for example with the aid of a button or the like. Corresponding commands are transmitted also for example from the associated local DALI control unit 11 or 21.

In an initial state it is now provided that all luminaires of the illumination system 1 work only within the scope of a base function, with which there is solely the possibility of switching on and switching off the lamps LA. A transmitted dimming value command is in this case fundamentally translated into a pure switch-on signal, in which the luminaire is operated with the power predetermined for the switched-on condition.

If now, for example, the user of subsystem A wishes to have the possibility also of dimming the lamps LA, he can in accordance with the invention obtain a license from the owner of the illumination system 1—that is, e.g. from the landlord of the building—for this. In order now to give the user of the subsystem A the possibility of dimming the luminaires LA in accordance with its wishes, the corresponding operational mode is now released by means of the central control device 2. This is effected in that the associated lamp operating devices 12-1 to 12-4 have corresponding commands passed thereto via the data lines 2, 10, which commands are used internally by the lamp operating devices to release the corresponding function. The lamp operating devices 12-1 to 12-4 may for this purpose have corresponding memory units, in which it is internally noted which functions and operational modes should be useable in what manner. Corresponding to this information, the lamp operating device 12-1 to 12-4 then reacts to externally transmitted commands via the bus line 10 of the DALI system. In the present case this means that the lamp operating devices 12-1 to 12-4 now convert DALI dimming commands into the corresponding control of the lamps LA and do not merely switch these on.

The release of the desired operational modes in the lamp operating devices 12-1 to 12-4 is effected by means of a corresponding software code or key, which is converted in suitable manner by the lamp operating devices 12-1 to 12-4. This software code may, inter alia, also be made specifically dependent upon the device type and the device number, so that a misuse, that is for example an unauthorized use of the dimming function of the lamp operating devices 12-1 to 12-4 is prevented to the greatest degree. In order further to avoid misuse, the licenses are also administered by means of the central control unit 2, in which it is noted which luminaires can be operated within the scope of an extended functional range. Also the local DALI control units can monitor whether the various devices are used within the scope of the licenses obtained.

After release of the selected functions, the user of the subsystem A can now use his lamp operating devices 12-1 to 12-4 corresponding to the extended functional scope. For example there is now available to him the possibility of dimming the luminaires also in a desired manner. Significant here is that for this purpose no alteration of the installation, or programming by hand of the devices 12-1 to 12-4, need be carried out. Instead, the release of the operational modes can be effected in simple manner by means of the central control device 2, for which reason the outlay is extremely small.

In the same manner there is then effected also the withdrawal of the dimming license, which for example is then necessary if the user of the corresponding subsystem no longer wishes a dimming function. By means of the central control device 2, this function can then in turn be again blocked, so that the lamp operating devices 12-1 to 12-4 can be used only in the conventional manner, that is for switching-on and for switching-off of the lamps LA. The licenses for use of the dimming function may for example be then passed on to other luminaires, for example two luminaires of the subsystem B.

It is important that not all lamp operating devices of a subsystem need have the same useable range of functions. Of course, in accordance with the invention, there is a possibility of releasing the dimming function purposively for individual luminaires. Beyond this it is to be noted that with the present invention the possibility would also be available of purposively making useable other functions or operational modes for the control of the luminaires. For example, in this manner also timer functions, by means of which an automatic time-dependent switching-on and switching-off of the lamps is made possible, can be released. Also a setting of the lamp brightness in dependence upon sensor signals or the like could be made useable in this manner for a user, so that this user can extend or restrict the comfort of the luminaire control in accordance with his wishes.

The remote controlled release or setting of certain functions and operational modes for the lamp operating devices 12-1 to 12-4 or 22-1 to 22-4 opens up beyond this also an improved possibility of luminaire maintenance which is now to be described with reference to FIGS. 2*a* to 2*c*.

As already explained above, with luminaires there arises fundamentally the problem that these suffer a reduction of their lighting power in the course of time. The reasons for this may be wear manifestations of the lamp and also dirtying of certain luminaire elements, for example of the reflectors or the like. Since the lighting power emitted by the luminaire should never fall below a desired lighting power, it is usual to so configure the luminaires in their production that at the beginning of their working life these emit an excess lighting power. For example it is to date known to so configure the luminaires that, in comparison to the desired lighting power, they emit at the beginning a lighting power increased by the factor 1.2.

As is schematically illustrated in FIG. 2*a*, a luminaire thus usually generates at the beginning of its working life a lighting power E1, which is above the desired power $L_0$. In the course of time, however, this power increasingly falls off due to aging phenomena, until at a time point $t_1$ the desired lighting power $L_0$ is attained. If the luminaire were now further used, the emitted lighting power would fall below the desired value, which however is not permitted. At the latest at the time point $t_1$ a servicing of the luminaire is thus necessary, in which this is, for example, intensively cleaned and the lamp replaced, so that a new cycle begins, with which in turn initially an increased lighting power is emitted, which in the above-described manner again falls in the course of time.

The output power, that is the lighting power, which the luminaire emits at the beginning of a service interval, could now be increased. As is illustrated in FIG. 2*b*, an increase output power $E_2$ at the beginning of a service interval has the consequence that the time point at which the luminaire, due to aging phenomena, reaches the desired lighting power $L_0$, can be deferred. In accordance with the illustration in FIG. 2*b*, a renewed servicing is necessary first at the time point $t_2$ which lies significantly after the time point $t_1$.

However, the simple increase of the output power brings with it the disadvantage that also over an extended period of time significantly more light is issued and therewith more energy is consumed, than is actually desired.

In accordance with a preferred exemplary embodiment of the present invention it is now provided that this excess lighting power is compensated in that the lamp, in switched-on condition at the beginning of a service interval, is controlled to a power reduced in comparison to the maximum power. As FIG. 2*c* schematically illustrates, in accordance with the invention the lamp power for the switched-on condition is thus set with a reduced factor F of about 80%, through which the excessive lighting power is compensated. Preferably, this factor F is so set that in the end in the switched-on condition at the beginning of a service interval exactly the desired lighting power $L_0$ is attained.

In the course of the usage time of the luminaire, the factor F, that is the output power of the lamp operating device, is successively raised, whereby the size of the respective increase depends upon the luminaire and lamp type. Such values obtained by experience are available, so that the factor can then always be altered so that it compensates for the reduction in the lighting power which is due to aging effects. Finally there is achieved through this that the luminaire emits the desired lighting power $L_0$ in switched-on condition, over its entire service interval. In practice, with the employment of DALI lamp operating devices, this can be effected in that for the switched-on condition at the beginning of a service interval a dimming value of for example 80% is predetermined, which in the course of time is stepwise increased. The drop in the lighting power of the luminaire is then compensated by means of the setting of a higher dimming value.

The particular advantage with the employment of the illumination system illustrated in FIG. 1 consists in that the adaptation of the power factor F can now be effected by means of the central control device 2 of the illumination system. In this control device 2 there is stored information regarding the respective lamp and luminaire types, so that the control unit 2 can reprogram the corresponding lamp operating devices to a new switch-on level at regular intervals, for example weekly or monthly.

This can for example be effected in that the control unit 2 contacts at regular intervals the lamp operating devices 12-1 to 12-4 or 22-1 to 22-4, temporally releases the dimming function and with the aid of a specific command sets a new brightness or power value for the switched-on condition within the scope of the base function. Through this, in simple manner, the desired lighting power for the luminaire can be permanently attained, whereby the tasks falling to service personnel are minimal.

It is to be noted that the adaptation of the light emission factor in dependence upon the state of wear of luminaires could also be effected for the extended dimming function to the effect that the maximum dimming value is always adapted so that it is finally ensured that over the entire usage period of time the same dimming range is always available.

The present invention thus permits, in simple manner, various functions to be made useable for the user of an illumination system in accordance with his wishes. The possibility of remotely controlled release of certain functions and reprogramming of the devices opens up, beyond this, also the possibility of realizing longer service time periods, and finally to save service costs, at the same time with energy saving.

The invention claimed is:

1. A lamp operating device constructed to operate a lamp, the lamp operating device being operable in one of a plurality of selectable operational modes, wherein the lamp operating device is constructed to receive at least one command for the selection and setting of the operational mode provided by a central control unit, and wherein the lamp operating device is also constructed to interpret at least one command provided by a local control unit, wherein the interpretation of the command provided by the local control unit is based on the operational mode selected and set by the central control unit, to control the lamp.

2. A method for operating a lamp, wherein the method comprises:

at a central control unit, issuing at least one command for the selection and setting of an operational mode of a lamp operating device;

at a local control unit, issuing at least one command for the control of the lamp;

at the lamp operating device, receiving and interpreting the at least one command from the central control unit and, in response to the command from the central control unit, selecting and setting the operational mode of the lamp operating device; and at the lamp operating device, receiving and interpreting the at least one command from the local control unit and operating the lamp independently based on both the selected operational mode of the lamp operating device and the received command from the local control unit.

3. The method according to claim 2, wherein at least one of the operational modes of the lamp operating device makes possible a dimming of the lamp.

4. The method according to claim 2, wherein the selection of the operational mode for the lamp operating device includes transmitting an external control command from the central control unit.

5. The method according to claim 4, wherein operating the lamp operating device operates the lamp in accordance with a base function when no operational mode has been selected.

6. The method according to claim 5, wherein operating the lamp operating device further includes switching on and switching off the associated lamp within a scope of the base function.

7. A system for operating a lamp comprising:

a lamp operating device constructed to operate a lamp;

a central control unit constructed to issue at least one command for the selection and setting of an operational mode of the lamp operating device;

a local control unit constructed to issue at least one command for the control of the lamp;

wherein, the lamp operating device is constructed to receive and interpret the at least one command from the central control unit and, in response to the command from the central control unit, the lamp operating device selects and sets the operational mode of the lamp operating device, and wherein the lamp operating device is constructed to operate the lamp independently based on both the at least one command received from the local control unit and the selected operational mode.

8. A lamp operating device constructed to operate a lamp, wherein the lamp operating device is constructed to select and set an operational mode of the lamp operating device based upon a reception and interpretation of at least one command from a central control unit, and wherein the lamp operating device is constructed to operate the lamp independently based on both the operational mode selected and at least one command received from a local control unit.

* * * * *